United States Patent [19]

Brinkley

[11] 4,053,761

[45] Oct. 11, 1977

[54] DECORATIVE ITEM

[76] Inventor: Jerry A. Brinkley, 1416 First Ave., NE., Winchester, Tenn. 37398

[21] Appl. No.: 668,201

[22] Filed: Mar. 18, 1976

[51] Int. Cl.[2] ..... F21S 13/10; F21S 1/02

[52] U.S. Cl. ..... 362/413; 362/404; 362/405

[58] Field of Search ..... 240/52.1, 52 R, 73 R, 240/73 BA, 73 BJ, 73 QD, 76, 78 E, 78 F, 78 R, 78 D, 84, 25, 78 LD, 10 R

[56] References Cited

U.S. PATENT DOCUMENTS

| | | | |
|---|---|---|---|
| 349,516 | 9/1886 | Perkins | 240/78 R |
| 1,368,674 | 2/1921 | Wohlauer | 240/78 LD |
| 1,607,413 | 11/1926 | Tillson | 240/78 LD |
| 1,837,091 | 12/1931 | Adams | 240/78 LD |
| 2,066,631 | 1/1937 | Le Gorre | 240/25 |
| 2,120,619 | 6/1938 | Matthiesen | 240/52.1 X |
| 2,254,988 | 9/1941 | Adams | 240/73 BA X |
| 2,456,179 | 12/1948 | Finer | 240/25 |
| 3,678,265 | 7/1972 | Porter et al. | 240/84 |
| 3,770,953 | 11/1973 | Riera | 240/73 BJ |
| 3,798,438 | 3/1974 | Menichetti | 240/10 R |
| 3,962,678 | 6/1976 | Kurokawa | 240/73 BA X |

FOREIGN PATENT DOCUMENTS

| | | | |
|---|---|---|---|
| 516,981 | 1/1940 | United Kingdom | 240/78 F |

*Primary Examiner*—Donald A. Griffin
*Attorney, Agent, or Firm*—Abe Hatcher

[57] ABSTRACT

A decorative antique comprising a variety of lamps and lights fitted to stovepipes so as to be lighted electrically.

2 Claims, 8 Drawing Figures

DECORATIVE ITEM

BACKGROUND OF THE INVENTION

1. Field of the Invention

This invention relates to decorative items. More particularly, it relates to a light fixture comprising generally a stovepipe or portion thereof having affixed to at least one usual opening thereof a lamp or light adapted to be lit up by electricity when turned on.

2. Description of the Prior Art

It is popular these days to furnish both new and old homes with fixtures which make them have an antique appearance. Some architects have chosen to electrically wire old lamps which used to be lighted by kerosene. Others have chosen to furnish houses with old stoves or new ones made to resemble antique ones. Another way of providing light to read or study by has been to supply light fixtures such as the lamp of U.S. Pat. No. 3,798,438, which is comprised of modular elements.

SUMMARY OF THE INVENTION

After extended investigation, I have found that the modern day needs for both lighting and antique decorative appearance may be provided by an old-fashioned stovepipe which has affixed to it one or more light fixtures such as a globe, lamp or light bulb, adapted to light up upon supplying it with electricity, which may come from a conventional electric light plug in a wall or other suitable location by appropriate wiring. The light-furnishing means may be joined to the end of the stovepipe or an L, T or like joint or section thereof in any desired manner, for example, by an adapter into which a light bulb and socket may be inserted, or by any other known means of attachment. Electric wiring may run through the inside of the stovepipe to a suitable source of electricity. Various means may be used to hold up the light-stovepipe fixture of the invention, for example, chains to hang it from a ceiling, or brackets to attach it to a wall. Many lamp or electric light/stovepipe designs may be used according to the invention, such as those illustrated in the drawing which forms a part hereof.

BRIEF DESCRIPTION OF THE DRAWING AND DESCRIPTION OF THE PREFERRED EMBODIMENTS

Figure 3:
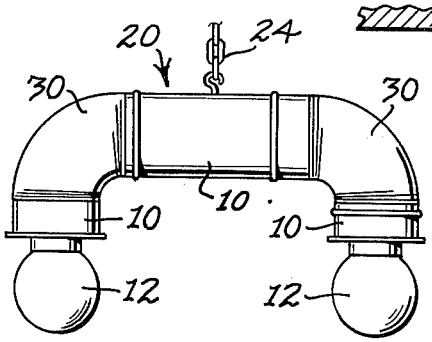
FIG. 3 is a schematic representation of another two-globe arrangement in which the globes are affixed to downward-pointing stovepipe L's joined together by a straight section of stovepipe suspended by a chain.
Figure 4:
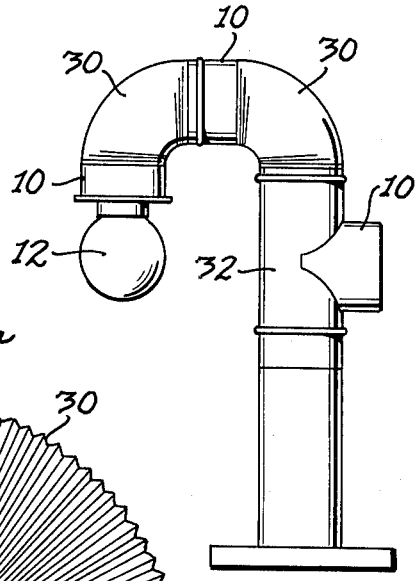
FIG. 4 is illustrative of a single-lamp type of stovepipe-light fixture according to the invention.
Figure 1:
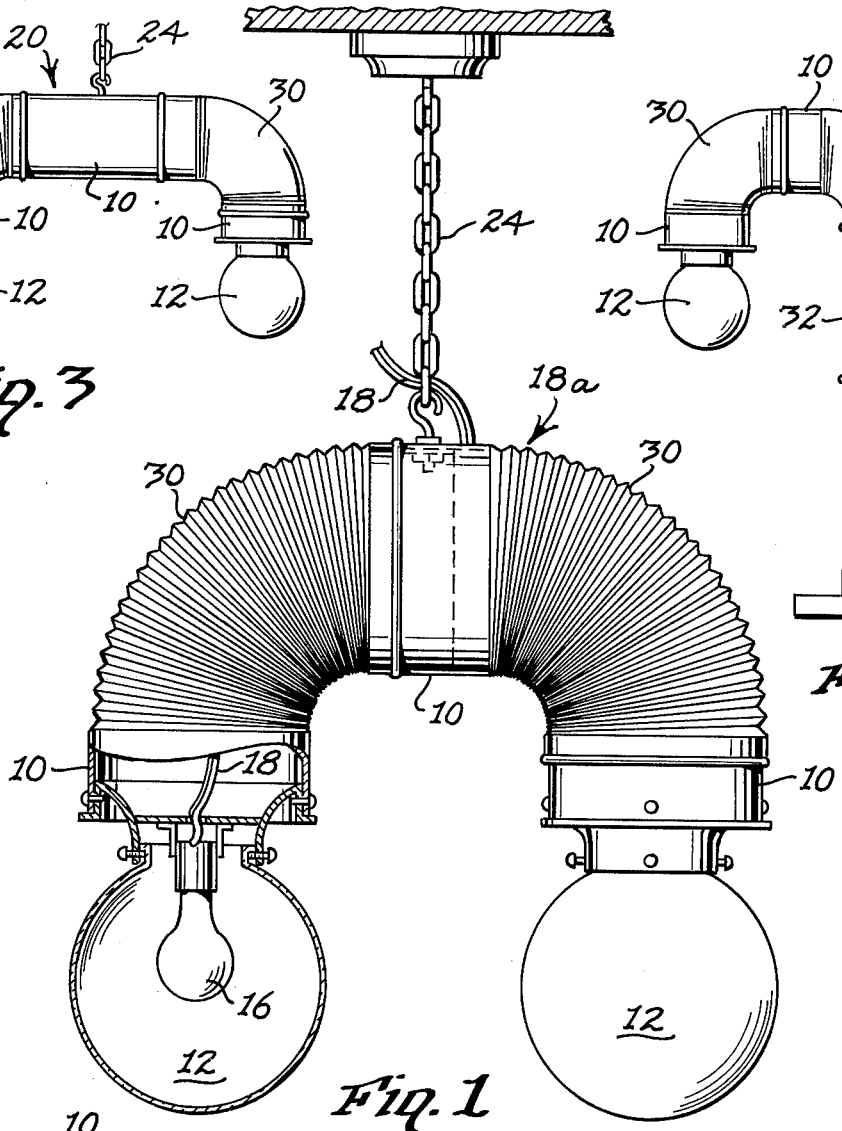
FIG. 1 is representative of a two-bulb arrangement according to the invention.
Figure 2:
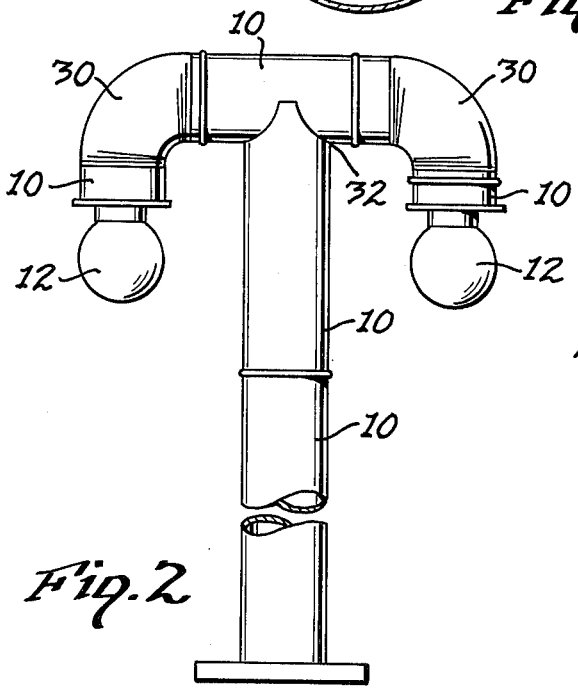
FIG. 2 shows a T-joint type of two-globe arrangement.
Figure 5:
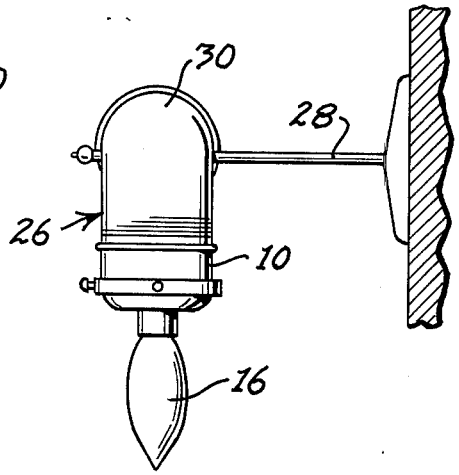
FIG. 5 shows a single-bulb fixture bracketed to a wall.
Figure 7:
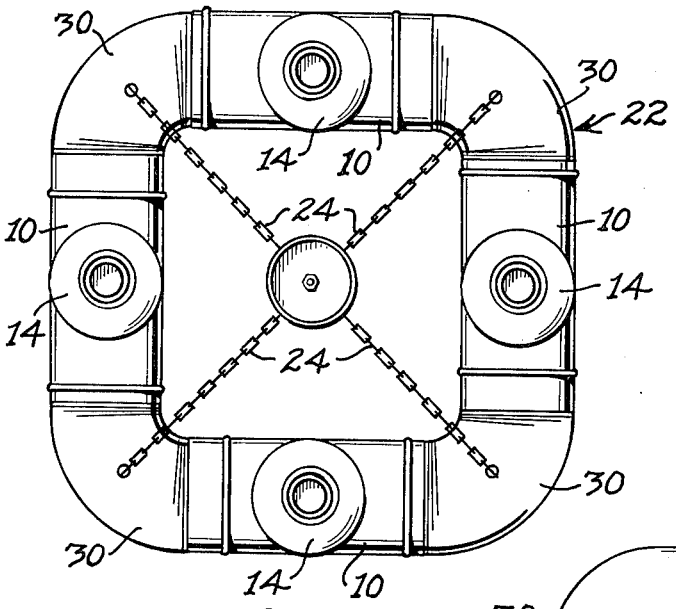
FIG. 7 is a view substantially from above of the fixture of FIG. 6.
Figure 8:
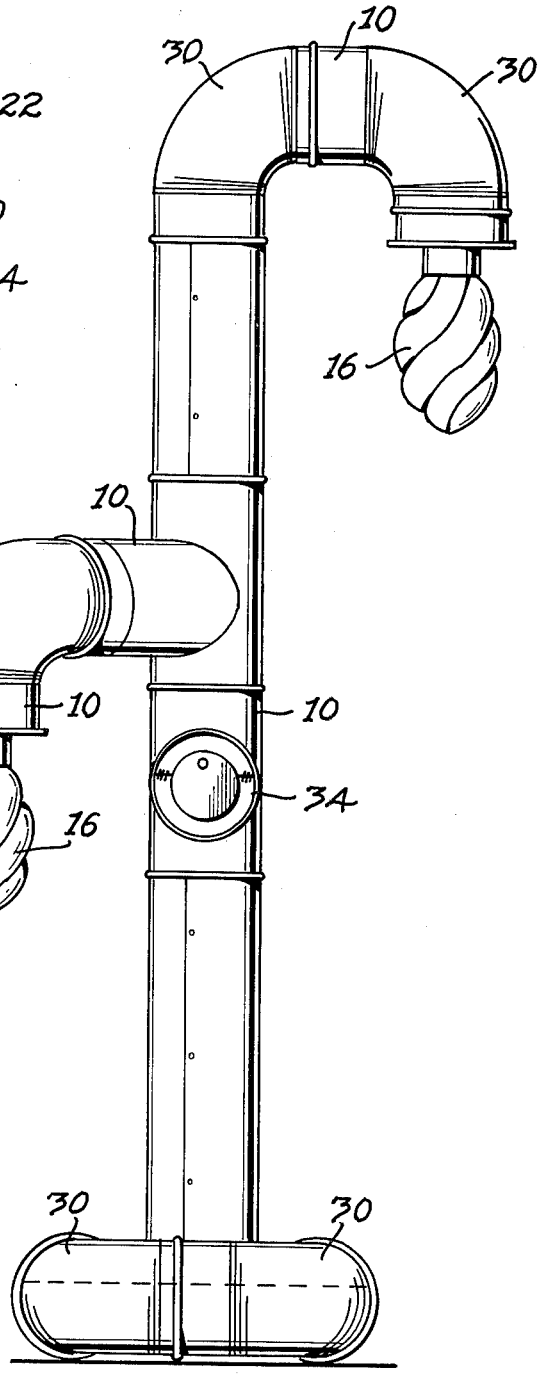
FIG. 8 is illustrative of another multiple-light arrangement of the stovepipe-lamp combination of the invention.
Figure 6:
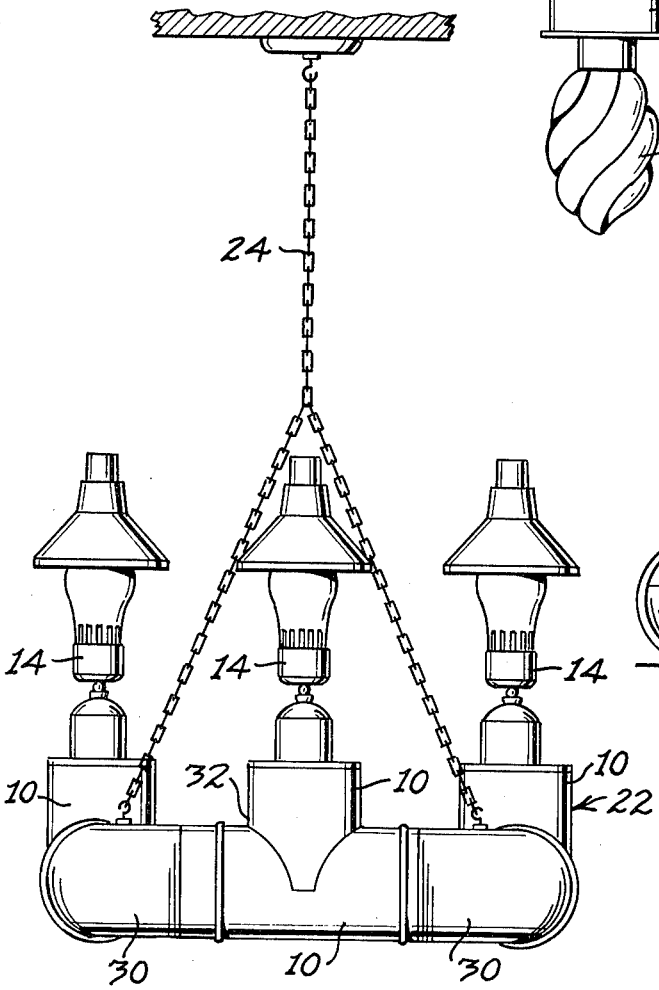
FIG. 6 represents a four-lamp arrangement according to the invention suspended from a ceiling.

In the drawing, sections of stovepipe 10 have light emitters such as globes 12, lamps 14 and bulbs 16 joined thereto and connected by electrical wiring 18 to an electrical source such as a wall or other socket (not shown). Fixtures such as 18*a,* 20 and 22 may be suspended by means of chains 24, and fixtures such as 26 by brackets or the like 28. Features of the light fixtures of the invention include various stovepipe joints such as L's or circular right-angle joints 30, T's 32, and the like, which are grooved so as to fit snugly into adjoining sections and joints, with openings or circular portions such as 34 for ornament or for attachment of additional sections or joints.

While the invention has been described in terms of preferred embodiments, the claims appended hereto are intended to encompass all embodiments which fall within the spirit of the invention.

Having thus described my invention and certain preferred embodiments thereof, I claim:

1. A decorative item comprising a section of stovepipe having affixed to at least one part thereof a light fixture equipped with at least one bulb adapted to light up when electricity is turned on, said light fixture comprising four lamps joined to projections from substantially the midpoints of the four sides of a square-shaped stovepipe arrangement comprising sections of stovepipe joined at the four corners of said square by L joints.

2. A decorative electric lamp comprising a plurality of sections of stovepipe joined together in an ornamental configuration such as a C-shape, T-shape, V-shape, fire hydrant shape or the like with electric light bulbs on the ends thereof adapted to light up when electricity is turned on, said stovepipe sections being snugly joined together in such a manner so as to allow the sections to be twisted relative to each other when joined to form the desired configuration and to normally retain said configuration until it is desired to change said configuration.

* * * * *